US012161208B2

(12) United States Patent
Casimir

(10) Patent No.: US 12,161,208 B2
(45) Date of Patent: Dec. 10, 2024

(54) MOTORIZED HANDHELD BRAIDING ASSEMBLY AND METHOD OF USE

(71) Applicant: MyKoa LLC, Miami, FL (US)

(72) Inventor: Taj-jasna Casimir, Miami, FL (US)

(73) Assignee: MyKoa LLC, Miami, FL (US)

( * ) Notice: Subject to any disclaimer, the term of this patent is extended or adjusted under 35 U.S.C. 154(b) by 347 days.

(21) Appl. No.: 17/631,878

(22) PCT Filed: Jul. 30, 2020

(86) PCT No.: PCT/US2020/044358
§ 371 (c)(1),
(2) Date: Jan. 31, 2022

(87) PCT Pub. No.: WO2021/022096
PCT Pub. Date: Feb. 4, 2021

(65) Prior Publication Data

US 2022/0273083 A1 Sep. 1, 2022

Related U.S. Application Data

(60) Provisional application No. 62/880,091, filed on Jul. 30, 2019.

(51) Int. Cl.
*A45D 24/22* (2006.01)
*A45D 2/00* (2006.01)
*A45D 8/34* (2006.01)

(52) U.S. Cl.
CPC ..... *A45D 2/00* (2013.01); *A45D 8/34* (2013.01); *A45D 2002/005* (2013.01)

(58) Field of Classification Search
CPC ..... A45D 2/00; A45D 2002/005; A45D 2002/006; A45D 2007/004
See application file for complete search history.

(56) References Cited

U.S. PATENT DOCUMENTS 4,369,690 A * 1/1983 Sapkus ..... A45D 2/00 87/8
5,988,181 A 11/1999 Gable et al.
6,827,089 B2 12/2004 Lee et al.
(Continued)

FOREIGN PATENT DOCUMENTS

WO WO-2017077265 A1 * 5/2017 ..... A45D 2/00

*Primary Examiner* — Rachel R Steitz
(74) *Attorney, Agent, or Firm* — Johnson Dalal; Mark C. Johnson

(57) ABSTRACT

A motorized handheld braiding assembly braids or weaves hair. The hair is selectively retained and carried in three adjacent hair retention heads. The hair retention heads securely fasten, and release the hair through one-handed operation. The hair retention heads are carried along a figure-8 pathway that creates a unique braiding pattern. The hair retention heads are carried on two rotating discs that rotate 360° in opposite directions. A hair clip on each hair retention head is height adjustable to fasten and release the lock of hair. The discs have three equally spaced slots that are radially disposed on an outer perimeter surface. The rotational motion of the discs carries each hair retention head in a revolution while fitted in the slot of the first disc, and then slidably passes each hair retention head on to a slot in the second disc where the rotation continues in the opposite direction.

19 Claims, 9 Drawing Sheets

(56) References Cited

U.S. PATENT DOCUMENTS

| | | | | |
|---|---|---|---|---|
| 7,069,935 | B2 | 7/2006 | Bousfield et al. | |
| 7,905,237 | B2 | 3/2011 | Noh | |
| 2003/0230316 | A1* | 12/2003 | Glucksman ..... | A45D 2/00<br>132/212 |
| 2009/0283107 | A1* | 11/2009 | Noh, ..... | A45D 8/34<br>87/50 |

* cited by examiner

MOTORIZED HANDHELD BRAIDING ASSEMBLY AND METHOD OF USE

CROSS REFERENCE OF RELATED APPLICATIONS

This is a national stage application of PCTUS2044358, filed Jul. 30, 2021, which claims the benefit of U.S. provisional application No. 62/880,091, filed Jul. 30, 2019, and entitled MOTORIZED BRAIDING ASSEMBLY, wherein said application is incorporated by reference herein in its entirety.

FIELD OF THE INVENTION

The present invention relates generally to a motorized handheld braiding assembly and method using the same and, more particularly, relates to a braiding assembly that selectively retains a lock of hair in three adjacent, spaced-apart hair retention heads, and carries the hair retention heads on a plurality of discs that are electrically powered to rotate 360°, whereby the hair retention heads translate along a sequential figure-8 pattern for unique hair braiding arrangements.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, hair braiding is a method of styling hair that involves interlacing multiple strands of hair. This can create an ornamental effect for the hair, and also serves to make a fashion statement. Hairstylists often use their hands and fingers to separate and weave hair into various braided fashions. However, hands and fingers can become cumbersome when braiding hair into complex designs and dividing the hair into multiple strands. It is also difficult for non-professional hairstylists to self-braid their hair using their hands for long periods without experiencing fatigue and pain in their joints. Mechanical devices have been developed to braid the hair in the past. However, these do not always secure the hair tightly in the braiding pathway. The braiding pathway is often a simple 360° rotation that does not address more complex hair braiding requirements and supports all hair textures. It has, therefore, become desirable to develop a device or instrument for accomplishing the braiding or weaving of hair by professional hairdressers and the uninitiated. It has also become desirable to develop a method for braiding hair which is easy to teach and to use.

Therefore, a need exists to overcome the problems with the prior art as discussed above.

SUMMARY OF THE INVENTION

The invention provides a motorized handheld braiding assembly and method of braiding hair that selectively retains a lock of hair in three adjacent, spaced-apart hair retention heads. The retention heads are carried on two adjacent discs that are electrically powered to rotate 360° and carry the hair retention heads along a sequential figure-8 pattern for unique hair braiding arrangements.

In some embodiments, a motorized handheld braiding assembly comprises a handheld body sized and dimensioned for gripping and manipulating, so as to achieve a hair braiding. The handheld body has a lower end, and an opposing upper end. The handheld body contains an electrical motor that is electrically couplable to a power source through a switch. The electrical motor is also operably coupled to a plurality of discs. Each disc is configured to rotate 360° on a disc axis. And each disc is defined by three equally spaced slots that radially disposed on an outer perimeter surface thereon.

In other embodiments, the braiding assembly may include three hair retention heads that are configured to selectively retain and release a lock of hair for braiding. Each hair retention head is disposed at the upper end of the handheld body. The hair retention head has a head shaft disposed within one of the three equally spaced slots defined by the plurality of discs. The hair retention head also has a head body coupled to the head shaft. The hair retention head also has a head upper surface.

In yet another embodiment, the hair retention head comprises a hair retaining clip with two opposing arms defining, with the head upper surface, a hair receiving aperture. The hair retention clip is configured to selectively and longitudinally translate to modulate a diameter of the hair receiving aperture and positionally lock with respect to the head body. This allows the hair retention clip to adjust in height, so as to selectively retain, and release the lock of hair.

The electrical motor is configured to cause rotation of the plurality discs; and thereby the three hair retention heads. This allows the hair retention heads to revolve in a sequential figure-8 pattern, thereby braiding a user's hair.

In another aspect, the handheld body further comprises at least two shell members coupled together about side edges respectively disposed thereon and having upper edges respectively disposed thereon that define an upper perimeter edge; and a body shell cover coupled to the upper perimeter edge, disposed at and defining the upper end of the handheld body, and defining two enclosed and partially connected disc apertures with the plurality discs disposed therein.

In another aspect, the shell members include a grip panel.

In another aspect, the two opposing arms of the hair retaining clip further comprise two respective opposing free ends selectively removably coupled from the head body and at least partially disposed in two clip apertures defined by the upper surface of the head body.

In another aspect, the head body further comprises at least one latch coupled thereto and operably configured to lockedly engage with a portion of at least one of the two opposing arms. In this manner, the latch positionally locks the two opposing arms with respect to the head body.

In another aspect, the at least one latch is biased in a lockedly engaged position with respect to the portion of at least one of the two opposing arms using at least one spring.

In another aspect, the head body further comprises a lower wall opposing the upper surface of the head body and defining a lower wall aperture with the head shaft disposed therein; an internal head platform translatably disposed within the head body and with the two respective opposing free ends directly coupled thereto; and a spring interposed between the lower wall of the head body and the internal head platform and biasing the internal head platform toward the upper surface.

In another aspect, the hair retaining clip is height adjustable relative to the upper surface of the head body.

In another aspect, the two opposing arms of the hair retaining clip are defined by multiple catch slots adapted to form a detachable snap-fit engagement with the at least one latch, whereby the catch slots enable the hair retaining clip to incrementally height adjust.

In another aspect, the hair retaining clip is defined by a U-shape.

In another aspect, the opposing ends of the U-shaped hair retaining clip comprise one or more prong members.

In another aspect, the switch is a momentary switch operably configured to have a translation position completing a circuit between the power source and the electrical motor only when depressed.

In another aspect, the braiding assembly further comprises a main power switch operably configured to have a translation position completing a circuit between the power source and the switch.

In another aspect, the electrical motor further is also operably coupled to a printed circuit board (PCB).

In another aspect, at least one of the two shell members is defined by a flat surface region.

In another aspect, a protective panel overlays the flat surface region.

In another aspect, the power source includes at least one of the following: a battery, an electrical outlet, a rechargeable dock, and an A/C-D/C converter.

In another aspect, the head body forms a cylindrical base defined by a cylindrical shape and a top concave portion, and comprising a plurality of flanges.

Although the invention is illustrated and described herein as embodied in a Motorized Handheld Braiding Assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting.

The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the handheld body.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION OF INVENTION

Figure 2:
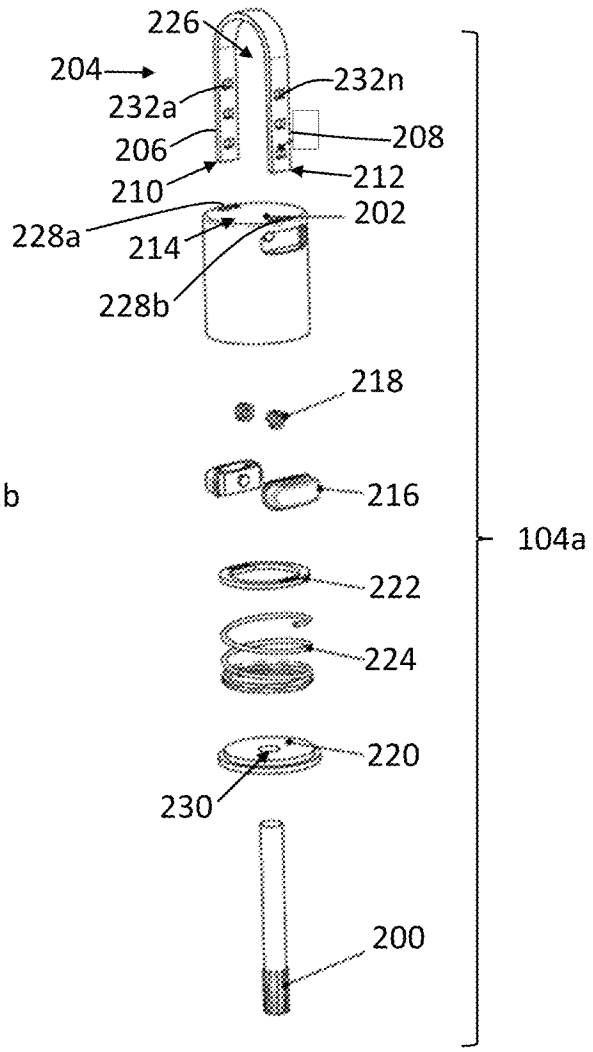
FIG. 2 is an exploded view of an exemplary hair retention head, in accordance with one embodiment of the present invention.

The invention described herein provides a motorized handheld braiding assembly that overcomes known disadvantages of those known devices and methods of this general type and that effectively, efficiently, and safely enables hair braiding. Although the invention is illustrated and described herein as embodied in a motorized handheld braiding assembly, it is, nevertheless, not intended to be limited to the details shown because various modifications and structural changes may be made therein without departing from the spirit of the invention. Additionally, well-known elements of exemplary embodiments of the invention will not be described in detail or will be omitted so as not to obscure the relevant details of the invention.

It is to be understood that the disclosed embodiments herein are merely exemplary of the invention, which can be embodied in various forms. Therefore, specific structural and functional details disclosed herein are not to be interpreted as limiting, but merely as a basis for future claims and as a representative basis for teaching one of ordinary skill in the art to variously employ the present invention in virtually any appropriately detailed structure. Further, the terms and phrases used herein are not intended to be limiting; but rather, to provide an understandable description of the invention. It is believed that the invention will be better understood from a consideration of the following description in conjunction with the drawing figures, in which like reference numerals are carried forward. The figures of the drawings are not drawn to scale.

The attached figures are incorporated in and form part of the specification, and serve to further illustrate various embodiments and explain various principles and advantages all in accordance with the present invention. Moreover, it is believed that the invention will be better understood from a consideration of the following description in conjunction with the drawing figures, in which like reference numerals are carried forward.

Referring now to FIGS. 1-13, embodiments of a motorized handheld braiding assembly 100 and method 1300 of braiding hair are shown. The figures show several advantageous features of the present invention, but, as will be described below, the invention can be provided in several shapes, sizes, combinations of features and components, and varying numbers and functions of the components.

Figure 1:
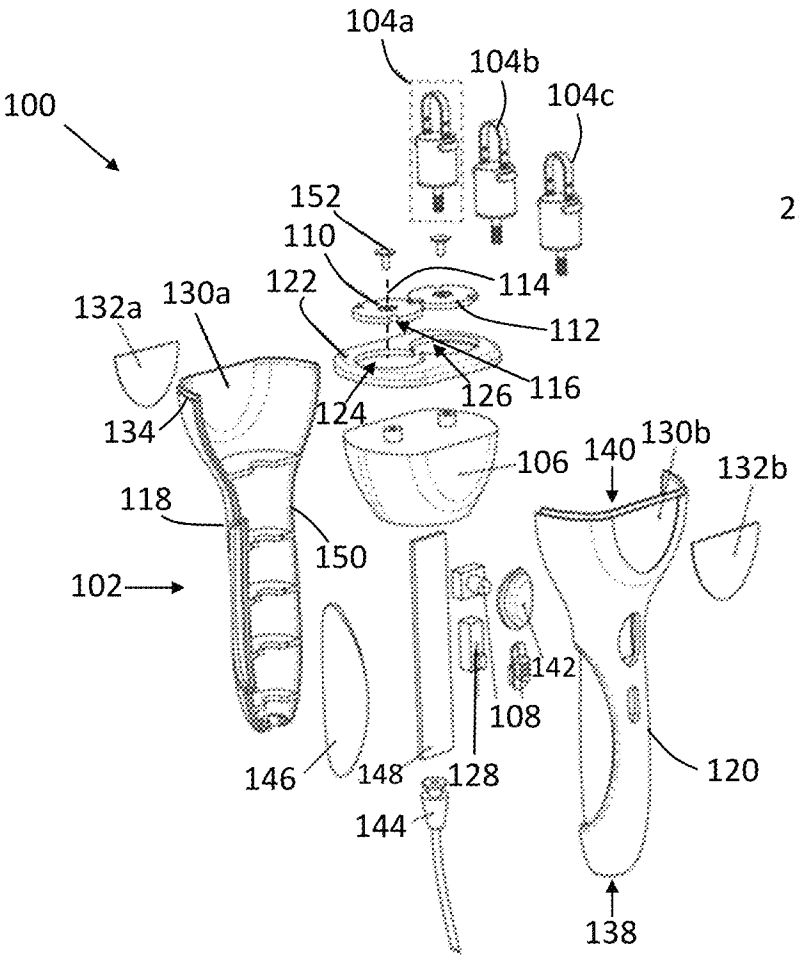
FIG. 1 is an exploded view of an exemplary motorized handheld braiding assembly, in accordance with one embodiment of the present invention.

As referenced in FIG. 1, the motorized handheld braiding assembly, hereafter "assembly" is a hand-held apparatus that electronically braids or weaves a lock of hair, or hair-like structures. The hair may be selectively retained and carried in three adjacent, spaced-apart hair retention heads. The hair retention heads are operable to securely fasten, and release the lock of hair through one-handed operation. The hair retention heads are carried along a figure-8 pathway that creates a unique braiding pattern for the hair. The hair retention heads are carried on two rotating discs that rotate up to 360° in opposite directions.

A hair retaining clip on each hair retention head is height adjusted by raising and lowering to fasten and release the lock of hair. The discs are defined by three equally spaced slots 116 that are radially disposed on an outer perimeter surface. The rotational motion of the discs carries each hair retention head in a revolution while fitted in the slot of the first disc, and then slidably passes each hair retention head on to a slot in the second disc where the rotation continues in the opposite direction.

Figure 6B:
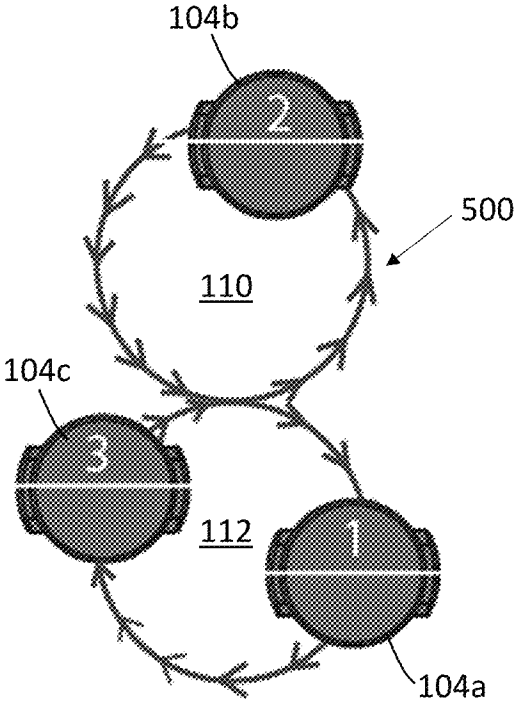
FIGS. 6A-6B are diagram views of the figure-8 pathway followed by the hair retention heads, showing the hair retention heads being passed between the rotating discs, in accordance with one embodiment of the present invention.
Figure 6A:
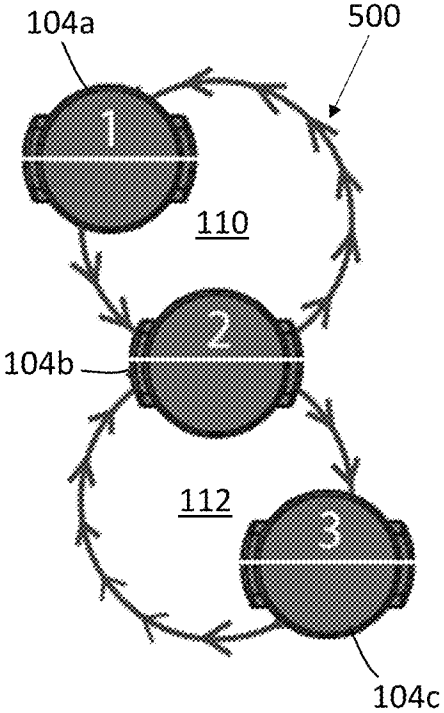
Figure 8:
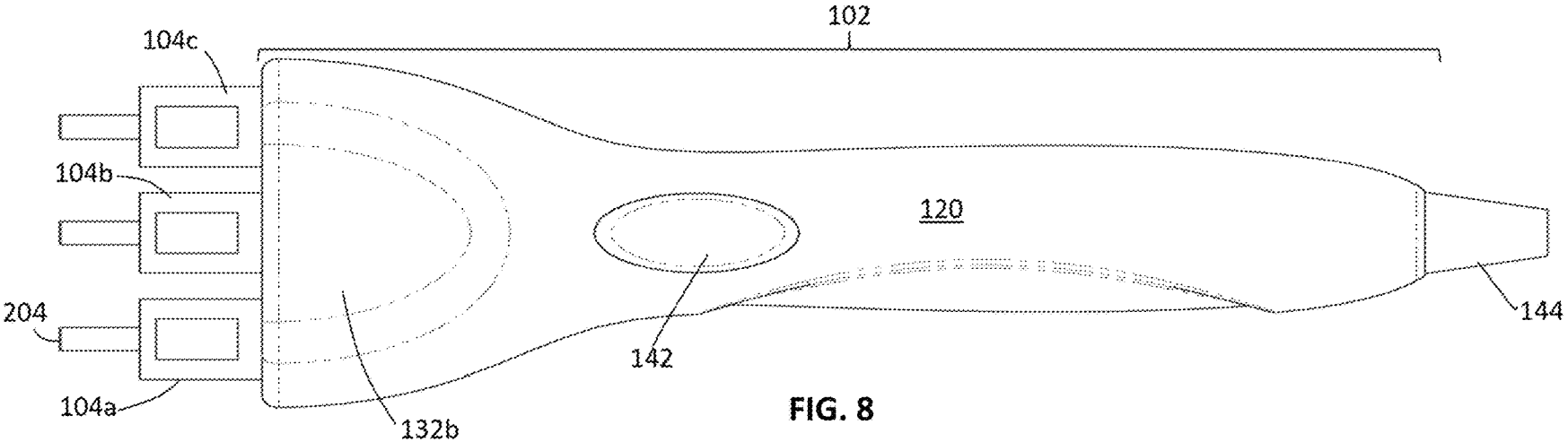
FIG. 8 is a frontal view of the handheld body of the motorized handheld braiding assembly, in accordance with one embodiment of the present invention.

For example, FIGS. 6A-6B reference the figure-8 pattern 500 followed by the hair retention heads 104*a-c*, showing the hair retention heads being passed between the rotating discs. A first hair retention head 104*a* is initially fitted into the slot of a first disc 110 (See FIG. 6A). As the first hair retention head 104*a* rotates, the slots for the two discs 110, 112 align, and the momentum of the first hair retention head 104*a* carries it to the second disc 112, which is rotating in an opposite direction. The same disc-to-disc pathway is followed by a second and third hair retention head 104*b-c*. Consequently, as the hair retention heads 104*a-c* ride the rotation of the discs, a sequential figure-8 braiding pattern 500 is followed, so as to braid the hair accordingly. In one embodiment, the plurality of discs 110, 112 may be rotatably coupled to the electrical motor 106 with one or more retaining pin(s) 152.

Figure 3:
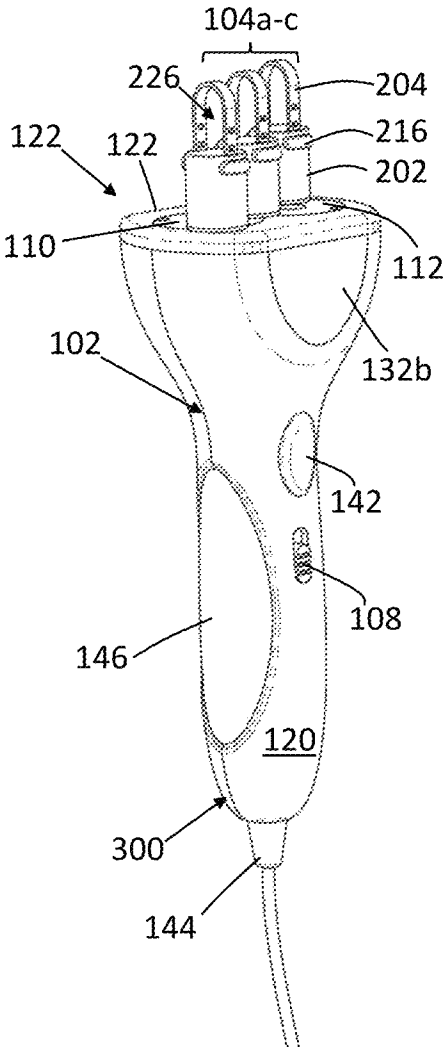
FIG. 3 is a front perspective view of the motorized handheld braiding assembly in accordance with one embodiment of the present invention.

A perspective front view of the assembly is illustrated in FIG. 3. As shown, the assembly 100 comprises a handheld body 102 that is sized and dimensioned for gripping and manipulating the entire assembly during the hair braiding process. The handheld body 102 is generally elongated and shaped to fit the hand of the user in a comfortable manner. In some embodiments, the handheld body 102 has a lower end 300, and an opposing upper end 302. The lower end 300 is proximal to the hand of the user, while the upper end 302 is more proximal to the hair that is being braided.

Figure 4:
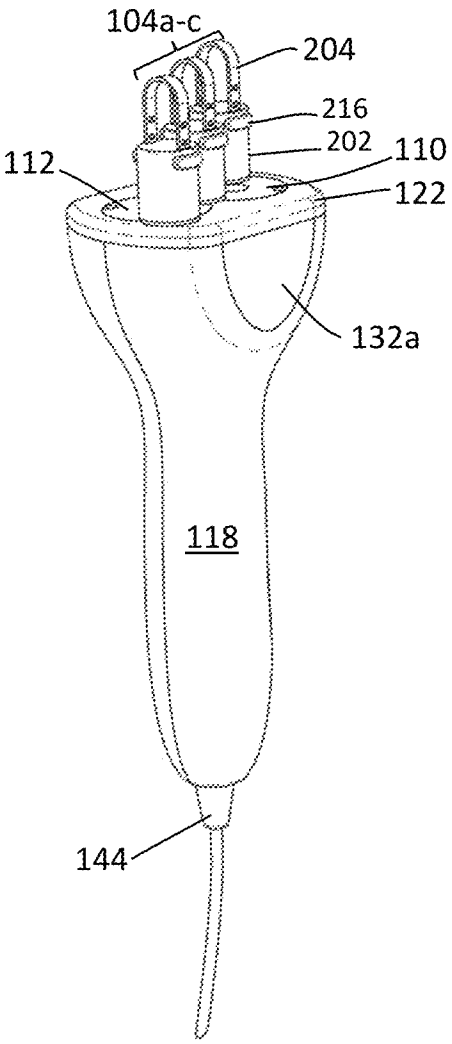
FIG. 4 is a rear perspective view of the motorized handheld braiding assembly shown in FIG. 3.

Looking ahead to FIG. 4, the handheld body 102 further comprises at least two shell members 118, 120 that couple together in a clam-shell relationship. The shell members 118, 120 may encapsulate (partially or wholly) the electric motor, power source, and/or electrical components, e.g., wiring, PCB board, microcontroller, etc. The shell members are defined by side edges 150 respectively disposed thereon. The side edges 150 have upper edges respectively disposed thereon that define an upper perimeter edge 134. The shell members 118, 120 may be fabricated from a substantially rigid polymeric material, e.g., PVC.

Figure 7:
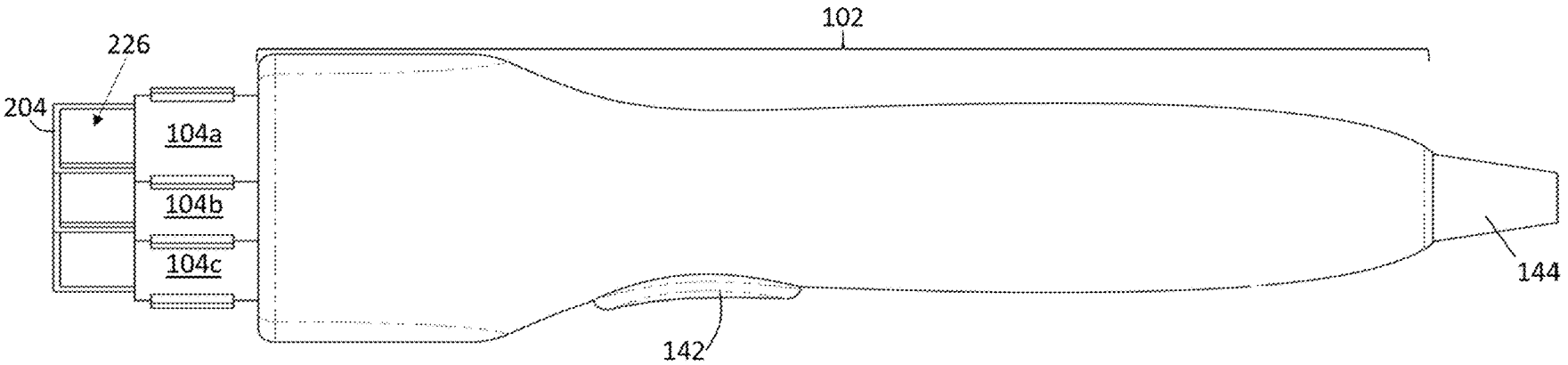
FIG. 7 is an elevated side view of the handheld body of the motorized handheld braiding assembly, in accordance with one embodiment of the present invention.

As FIG. 7 shows, the shell members 118, 120 include a grip panel 146 that offers comfort to the user while braising the hair. The grip panel 146 may also be configured to absorb sweat; thereby enhancing grip of the handheld body 102. At least one of the two shell members 118, 120 is defined by a flat surface region 130*a*, 130*b*. The flat surface region 130*a-b* prevents the handheld body 102 from rolling off a surface. In one possible embodiment, a protective panel 132*a*, 132*b* overlays the flat surface region 130*a*, 130*b*.

In some embodiments, a body shell cover 122 couples to upper perimeter edge 134 of the shell members 118, 120. The body shell cover 122 is disposed perpendicular to the side edges of the shell members 118, 120. The body shell cover 122 defines the upper end 302 of the handheld body 102. As illustrated in FIG. 8, the body shell cover 122 defines two enclosed and partially connected disc apertures 124, 126 that are sized and dimensioned to retain a plurality of discs 110, 112 for rotational operation. In one non-limiting embodiment, the disc apertures 124, 126 are circular in shape.

An electrical motor 106 resides in the handheld body 102. The electrical motor 106 is electrically couplable to a power source 144 through a switch 108. The electrical motor may be AC and/or DC and may be of a direct drive, linear, servo, and/or stepper motor configuration and functionality. The electrical motor 106 may also utilize one or more linkages, cams, or cam paths to facilitate in guiding a plurality of plurality of hair retention heads 104*a-c* in figure-8 desired braiding path, as discussed below. In some embodiments, the power source 144 may include, without limitation, a battery, a rechargeable battery, an electrical outlet, a rechargeable dock, and an A/C-D/C converter. However, any source of energy that rotates the discs 110, 112 may be used.

Figure 10:
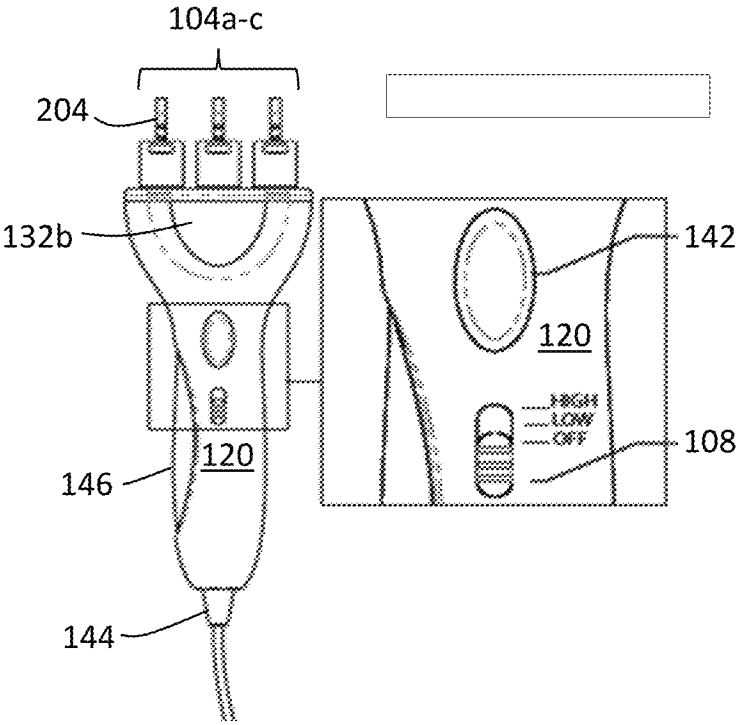
FIG. 10 is a perspective view of the assembly, showing a close-up view of the switches, in accordance with one embodiment of the present invention.

Looking ahead to FIG. 10, the handheld configuration of the assembly requires various switches for controlling power and speed of the hair retention heads 104*a-c* while braiding the hair. A speed switch 108 may include a momentary switch. The switch 108 is operably configured to have a translation position completing a circuit between the power source 144 and the electrical motor 106 only when depressed. The assembly may also utilize a main power switch 128 for powering on and off the electric motor. The power switch 128 is configured to have a translation position completing a circuit between the power source 144 and the switch 108. In one possible embodiment, the electrical motor is also operably coupled to a printed circuit board (PCB) 148, which helps in controlling the different electrical components in the assembly 100.

The electrical motor 106 is also operably coupled to a plurality of discs 110, 112. In one non-limiting embodiment, two adjacent, equally sized discs 110, 112 are used. The electrical motor 106 is configured to cause rotation of the discs 110, 112 in opposite directions, and at a full revolution of 360°.

As discussed above, each disc is configured to rotate 360° on a disc axis 114 while fitted in the disc apertures 124, 126 of the body shell cover 122. Each disc is defined by three equally spaced slots 116 that radially disposed on an outer perimeter surface thereon.

Figure 5:
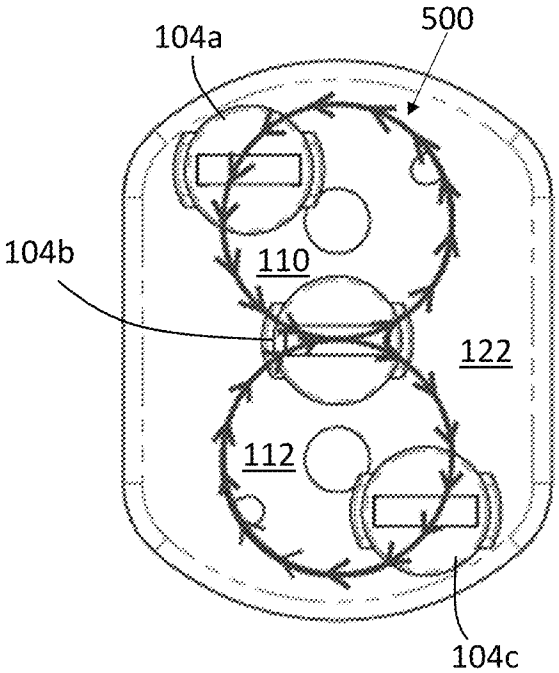
FIG. 5 is a top plan view of three hair retention heads being carried by a pair of discs across a body shell cover in a figure-8 braiding pattern, in accordance with one embodiment of the present invention.

Looking back at FIG. 2, the braiding assembly 100 provides a plurality of hair retention heads 104*a-c* that work to selectively and incrementally retain a lock of hair while simultaneously being carried by the discs 110, 112 along the figure-8 braiding pattern 500. Each hair retention head is disposed at the upper end 302 of the handheld body 102 and are operably configured to retain a user's hair and move in a sequential braiding pattern to braid the hair, wherein said pattern is best depicted in FIG. 5. In one non-limiting embodiment, the braiding pattern 500 is a figure-8 pattern.

Figure 12B:
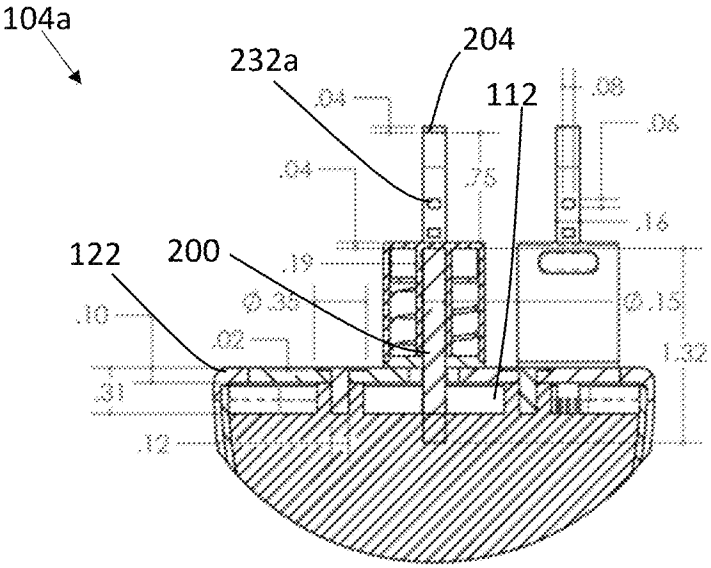
FIGS. 12A-12B are sectioned top views of the assembly, showing a close-up view of the hair retention heads, and showing exemplary dimensions in inches, in accordance with one embodiment of the present invention.
Figure 12A:
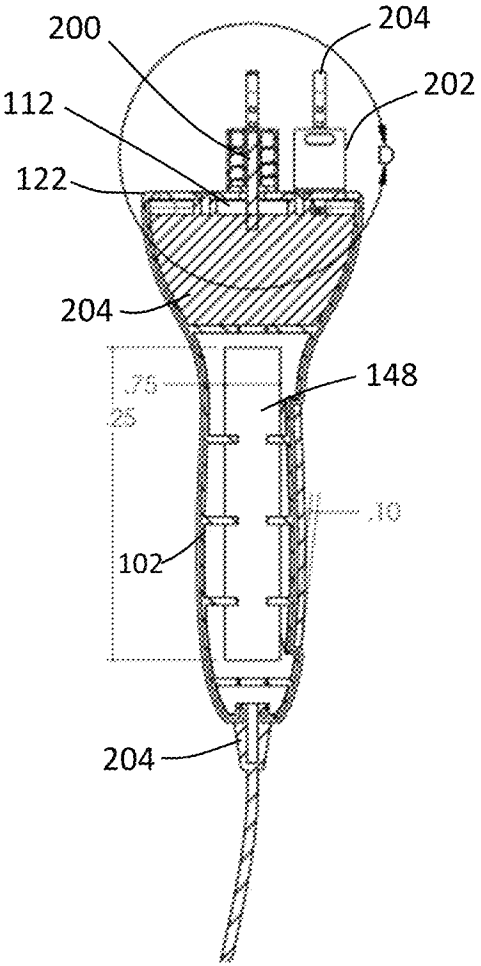

FIG. 12A is a sectioned top view of the assembly, showing a close-up view of the hair retention heads, and showing dimensions in inches for the two shell members 118, 120, the hair retention heads 104*a-c*, and the discs 110, 112. As depicted in FIG. 12B, each of the plurality of hair retention heads 104*a-c* may include a head body 202 coupled to the electric motor 106. Further, the hair retention head 104*a-c* also has a head upper surface 214 that may be selectively translatably coupled to the head body 202. The head body 202 may be fabricated from a substantially rigid polymeric or other material.

Continuing, the hair retention head 104*a-c* has a head shaft 200 fitted within one of the three equally spaced slots 116 that form in the discs 110, 112. The discs are rotated by the electrical motor 106 while carrying the hair retention heads in the slots. The discs carry the hair retention heads 104*a-c* in a revolution, passing each hair retention head through slots at the perimeter surface of the discs. This allows the hair retention heads to ride both discs, and revolve in a sequential figure-8 braiding pattern; thereby braiding the hair.

As discussed above, the electrical motor 106 utilizes one or more linkages, cams, or cam paths to facilitate in guiding the hair retention heads 104*a-c* in the figure-8 braiding pattern 500, as discussed below. In one preferred embodiment, the plurality of plurality of hair retention heads 104*a-c* include three heads operably coupled to the electrical motor. Though in other embodiments, more or less than three hair retention heads may be used.

In yet another embodiment, the hair retention head comprises a hair retaining clip 204 with two opposing arms 206, 208 defining, with the head upper surface 214, a hair receiving aperture 226. The hair retention clip 204 is configured to selectively and longitudinally translate to modulate a diameter of the hair receiving aperture 226 and positionally lock with respect to the head body 202. This allows the hair retention clip to adjust in height, so as to selectively retain, and release the lock of hair.

Figure 11B:
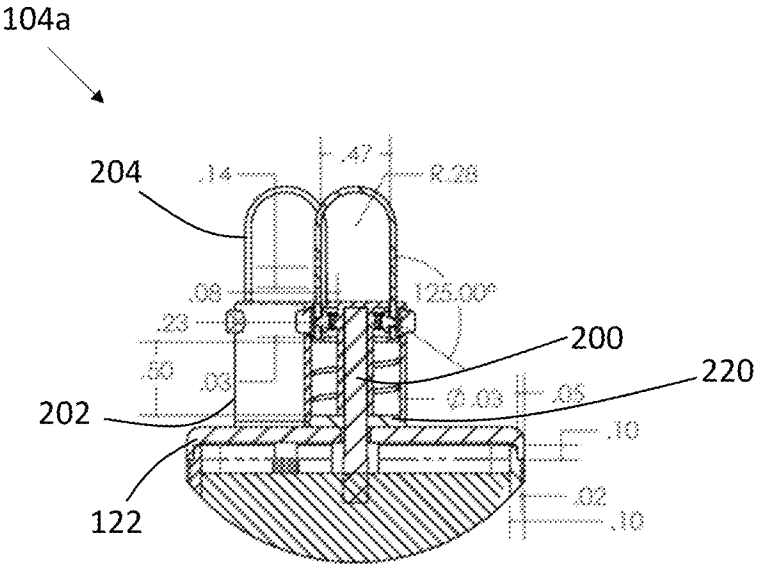
FIGS. 11A-11B are sectioned top views of the assembly, showing a close-up view of the hair retention heads, and showing exemplary dimensions in inches, in accordance with one embodiment of the present invention.
Figure 11A:
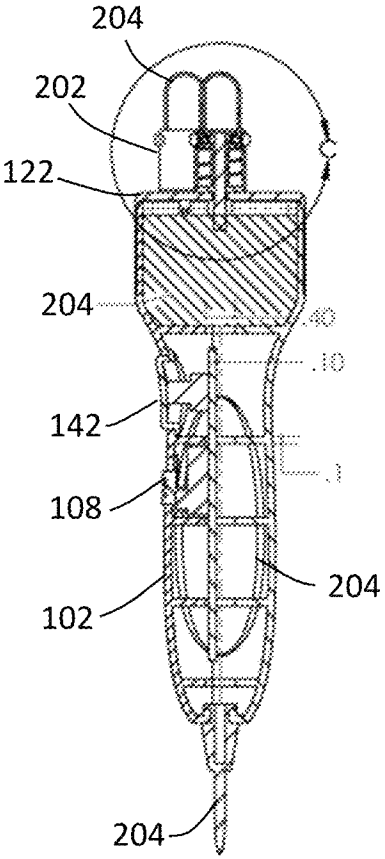

As shown in FIG. 11A, the two opposing arms 206, 208 of the hair retaining clip 204 terminate at two respective free ends 210, 212. The free ends 210, 212 are configured to be selectively removably coupled from the head body 202. The free ends 210, 212 are at least partially disposed to pass through two clip apertures 228*a*, 228*b* that define the upper surface 214 of the head body 202. In one possible embodiment, the hair retaining clip is defined by a U-shape (See FIG. 11B). However, other looped or partially enclosed shapes may also be used to define the hair retaining clip. In any case, the hair retaining clip 204 encloses a lock of hair, for braiding.

In another embodiment, the head body 202 comprises at least one latch 216 that is coupled thereto. The latch 216 is operably configured to lockedly engage with a portion of at least one of the two opposing arms 206, 208. In this manner, the latch positionally locks the two opposing arms 206, 208 with respect to the head body 202. The at least one latch 216 may be biased in a lockedly engaged position with respect to the portion of at least one of the two opposing arms 206, 208, through use of at least one spring 218.

This height-adjustability is possible because the two opposing arms 206, 208 of the hair retaining clip 204 are defined by multiple catch slots 232*a*, 232*n* adapted to couple and decouple to the at least one latch 216 in a snap-fit relationship. The catch slots 232*a-n* create a snap-fit relationship with the free ends of the arms, so as to enable the hair retaining clip 204 to incrementally height adjust. This allows the hair retaining clip 204 to be set at a desired height relative to the upper surface 214 of the head body 202. In other embodiments, the prong members of the hair retaining clip 204 are effective for coupling to the latch 216.

When employing the use of hair retaining clip 204, one or more compression fasteners are operably configured to facilitate in applying a compression force on the hair retaining clip 204, e.g., using a spring.

As such, in one embodiment, a user may depress compression fastener to enable the user to move the clip longitudinally (and linearly) and, when the user releases the compression fastener, the hair retaining clip 204 will be frictionally retained (thereby retaining the user's hair).

In one non-limiting embodiment, the opposing ends of the U-shaped hair retaining clip comprise one or more prong members. The hair retaining clip 204 may include one or more prong members that enables the hair retaining clip 204 to lock to the upper surface 214 of the head body 202, and prevent the hair retaining clip 204 from being removed longitudinally unless intentionally manipulated and/or deformed by the user. The hair retaining clips 204 may be of interchangeable and different sizes and shapes depending on the hair type desired to be retained.

Figures 9A, 9B, 9C:
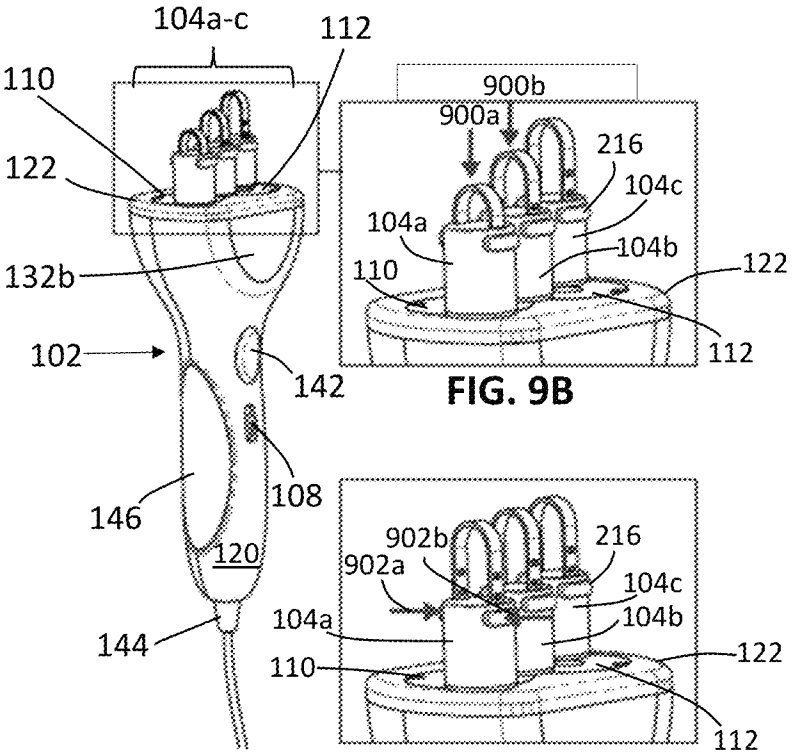
FIGS. 9A-9C are perspective views of the hair retention heads, showing close-ups of the hair clips in a raised and lowered height, in accordance with one embodiment of the present invention.

As shown in FIGS. 9A-9C, the selective and incremental height adjustments of the hair retaining clip 204 allow the lock of hair to be fastened into the respective hair retention head 104*a-c* at a selected firmness, or completely released from the hair retention heads 104*a-c*. For example, three incrementally different heights are possible for each hair retention head 104*a*, 104*b*, 104*c*. FIG. 9B illustrates how a first hair retaining clip on a first hair retention head 104*a* is at a low height, clamping down on a lock of hair.

An adjacent, second hair retaining clip on a second hair retention head 104*b* is at a fully elevated height, so as to release the hair. And an adjacent, third hair retaining clip on a third hair retention head 104*a* is at a middle height, so as to loosely retain a lock of hair. To adjust the height of the hair retaining clip 204, the user may selectively translate the hair retaining clip 204 along a path (represented with arrows 900*a-b*) to various locked positions (as shown best in FIG. 9B). The hair retaining clip 204 may be released from its locked position by depressing one or more of the latches 216 along a path (represented with arrows 902*a-b*).

Consequently, as the hair retention heads 104*a-c* follow the figure-8 braiding pattern 500, the first hair retention head 104*a* creates a tight weave or braiding effect. The third hair retention head 104*c*, having the third hair retaining clip in the middle, loosely retains the hair, forming a loose braid. The second hair retention head 104*b* does not carry any hair, and thus does not create a braid. Thus, the heights of the hair retention clips can be adjusted to achieve a desired braiding effect. In another example, FIG. 9C shows all the hair retaining clip raised to the highest height to release the hair after braiding.

In alternative embodiments, elastic hair ties are used to retain the lock of hair, rather than the hair retaining clip 204. In some embodiments, the head body 202 forms a cylindrical base. The cylindrical base is defined by a cylindrical shape and a top concave portion. A plurality of flanges projects from the base. The flanges can be used to receive an elastic hair tie, or other hair retention bands known in the art. Said another way, a user may place a user's hair desired to be braided within a top concave portion before retaining it with an elastic hair tie and flanges. In other embodiments, the flanges facilitate in retaining just a user's hair without elastic hair ties.

Looking back at FIG. 1, the head body 202 further comprises a lower wall 220 that is opposite the upper surface 214 of the head body 202. The lower wall 220 is defined by a lower wall aperture 230 with a head shaft 200 disposed therein. The discs rotate about the shaft 200 in a 360° range. Further, an internal head platform 222 is translatably disposed within the head body 202 and with the two respective opposing free ends 210, 212 directly coupled thereto.

In some embodiments, a spring 224 is interposed between the lower wall 220 of the head body 202 and the internal head platform 222. The spring 224 serves to bias the internal head platform 222 toward the upper surface 214. This enables the latch 216 and the catch slots 232*a-n* to couple and decouple in a snap-fit relationship. This biasing effect also helps retain the components of the hair retention heads 104*a-c* together.

As those of skill in the art will appreciate, when desired for use, the user will insert his or her hair onto or into the hair retaining clip 204 of the hair retention heads 104*a-c* for retention. Once retained, the user will electrically couple the electrical motor to the power source, e.g., by completing a circuit. In one embodiment, the switch may manually move the plurality of hair retention heads in the desired pattern, e.g., a figure-8 braiding pattern 500, only while the switch or button is depressed. In other embodiments, the movement of the switch to an activation position will move the plurality of hair retention heads in the desired pattern for a predetermined period of time, e.g., one minute. In said embodiments, a microcontroller may be communicatively and electrically coupled to the electrical motor and may also include preprogrammed and timed settings resident on a memory stored on a PCB board.

The user actuates operation of the discs in a rotational revolution of 360°, with each disc rotating in an opposite direction. The discs carry the hair retention heads 104*a-c*, passing the hair retention heads 104*a-c* to each other when the slots for each respective disc align. This allows the hair retention heads 104*a-c* to follow the figure-8 braiding pattern 500. When the user is finished braiding his or her hair, the user will electrically uncouple the electrical motor from the power source and remove the one or more clips (thereby allowing the user's hair to be effectively and safely removed).

Figure 13:
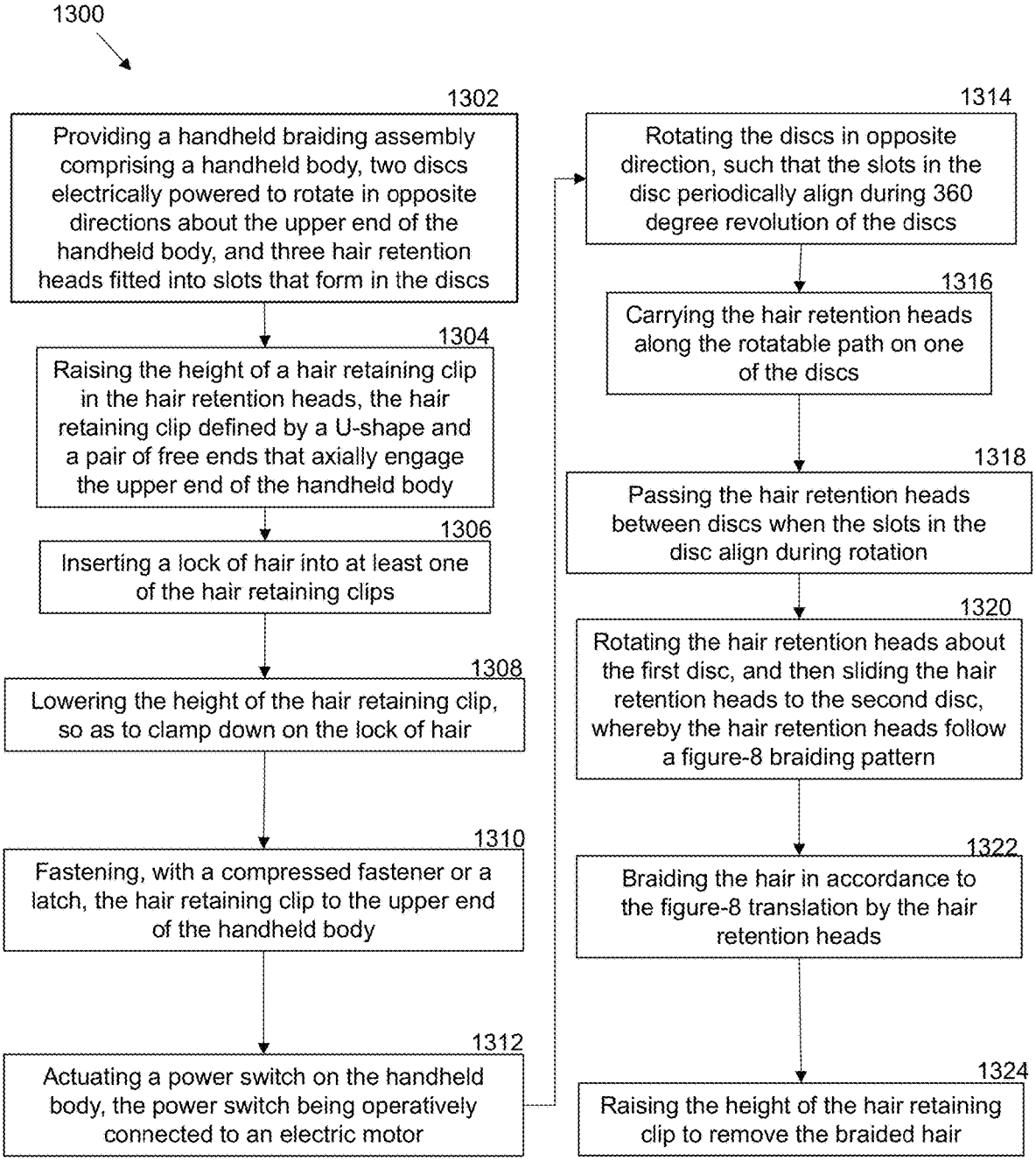
FIG. 13 is a flowchart of an exemplary method of braiding the hair with a motorized handheld braiding assembly, in accordance with one embodiment of the present invention.

FIG. 13 references a flowchart for an exemplary method 1300 of braiding the hair with a handheld braiding assembly. The method 1300 may include an initial Step 1302 of providing a handheld braiding assembly comprising a handheld body, two discs electrically powered to rotate in opposite directions about the upper end of the handheld body, and three hair retention heads fitted into slots that form in the discs. The assembly is a hand-held apparatus that electronically braids or weaves a lock of hair, or hair-like structures.

The hair is selectively retained and carried in three adjacent, spaced-apart hair retention heads. The hair retention heads are operable to securely fasten, and release the lock of hair through one-handed operation. The hair retention heads are carried along a figure-8 pathway that creates a unique braiding pattern for the hair. The hair retention heads are carried on two rotating discs that rotate up to 360° in opposite directions.

Further, a hair retaining clip on each hair retention head is height adjusted by raising and lowering to fasten and release the lock of hair. The discs are defined by three equally spaced slots 116 that are radially disposed on an outer perimeter surface. The rotational motion of the discs carries each hair retention head in a revolution while fitted in the slot of the first disc, and then slidably passes each hair retention head on to a slot in the second disc where the rotation continues in the opposite direction.

The method 1300 may further comprise a Step 1304 of raising the height of a hair retaining clip in the hair retention heads, the hair retaining clip defined by a U-shape and a pair of free ends that axially engage the upper end of the handheld body. The U-shaped configuration of the hair retaining clip allows the user to easily lift the clip with a finger. In one possible embodiment, the hair retaining clip is biased towards the lower position, and therefore must be forcibly raised.

A Step 1306 includes lowering the height of the inserting a lock of hair into at least one of the hair retaining clips. The lock of hair, or hair-like strand, is inserted into a hair receiving aperture that forms in the hair retaining clip. After inserting the hair, the hair retaining clips are onto the hair. In some embodiments, a Step 1308 comprises lowering the height of the hair retaining clip, so as to clamp down on the lock of hair. A Step 1310 includes fastening, with a compressed fastener or a latch, the hair retaining clip to the upper end of the handheld body. The body of the hair retaining heads an interior latch that couples and decouples from the free ends of the hair retaining clip. However, in other embodiments, a compressed fastener may be used to fasten the hair retaining clip onto the hair. This fastening step is important so that the hair remains in place while being braided, weaved, or otherwise manipulated.

In some embodiments, a Step 1312 may include actuating a power switch on the handheld body, the power switch being operatively connected to an electric motor. The power switch is on the side of the handheld body within reach of a thumb or finger. A speed switch may also be available to regulate the speed of the rotation of discs; and thereby braiding speed by the hair retention heads. This may include a low, medium, high speed level selection.

A Step 1314 comprises rotating the discs in opposite direction, such that the slots in the disc periodically align during 360-degree rotation/revolution of the discs. The discs rotate in opposite directions, so as to achieve the figure-8 pattern. The method 1300 may further comprise a Step 1316 of carrying the hair retention heads along the rotatable path on one of the discs. The base of the hair retention heads coupled to the slots that form in the discs. A Step 1318 includes passing the hair retention heads between discs when the slots in the disc align during rotation. The momentum from the rotation allows the hair retention heads to be displaced between discs when the slots of the discs align.

Another Step 1320 includes rotating the hair retention heads about the first disc, and then sliding the hair retention heads to the second disc, whereby the hair retention heads follow a figure-8 braiding pattern. The method 1300 may also include a Step 1322 of braiding the hair in accordance to the figure-8 translation by the hair retention heads. The figure-8 braiding pattern 500 offers the user a unique and more complex braiding possibility for the hair. This is more than a simple twisting or rotating braiding motion can offer. This is also more effective than using the hands to raid the hair. A final Step 1324 includes raising the height of the hair retaining clip to remove the braided hair. The hair can be re-braided as many times as needed to achieve the desired fashion.

Although a specific order of executing process steps has been disclosed, the order of executing the steps may be changed relative to the order shown in certain embodiments. Also, two or more steps may be executed concurrently or with partial concurrence in some embodiments. Certain steps may also be omitted for the sake of brevity.

What is claimed is:

1. A motorized handheld braiding assembly comprising:

a handheld body having a lower end, an upper end opposing the lower end of the handheld body, and an electrical motor electrically couplable to a power source through a switch and operably coupled to a plurality of discs each operably configured to rotate 360° on a disc axis and each having three equally spaced slots radially disposed on an outer perimeter surface thereon; and three hair retention heads each:

disposed at the upper end of the handheld body;

having a head shaft disposed within one of the three equally spaced slots defined by the plurality discs;

having a head body coupled to the head shaft and having a head upper surface defining two clip apertures; and a hair retaining clip with two opposing arms defining, with the head upper surface, a hair receiving aperture and operably configured to selectively and longitudinally translate to modulate a diameter of the hair receiving aperture and positionally lock with respect to the head body and having two respective opposing free ends selectively removably coupled from the head body and at least partially disposed in the two slip apertures, the electrical motor operably configured to cause rotation of the plurality discs and the three hair retention heads to revolve in a sequential figure-8 pattern, thereby braiding a user's hair.

2. The motorized handheld braiding assembly according to claim 1, wherein the handheld body further comprises:

at least two shell members coupled together about side edges respectively disposed thereon and having upper edges respectively disposed thereon that define an upper perimeter edge; and a body shell cover coupled to the upper perimeter edge, disposed at and defining the upper end of the handheld body, and defining two enclosed and partially connected disc apertures with the plurality discs disposed therein.

3. The motorized handheld braiding assembly according to claim 1, wherein the head body further comprises:

at least one latch coupled thereto and operably configured to lockedly engage with a portion of at least one of the two opposing arms, thereby positionally locking the two opposing arms with respect to the head body.

4. The motorized handheld braiding assembly according to claim 3, wherein:

the at least one latch is biased in a lockedly engaged position with respect to the portion of at least one of the two opposing arms using at least one spring.

5. The motorized handheld braiding assembly according to claim 4, wherein the head body further comprises:

a lower wall opposing the upper surface of the head body and defining a lower wall aperture with the head shaft disposed therein;

an internal head platform translatably disposed within the head body and with the two respective opposing free ends directly coupled thereto; and a spring interposed between the lower wall of the head body and the internal head platform and biasing the internal head platform toward the upper surface.

6. The motorized handheld braiding assembly according to claim 5, wherein:

the hair retaining clip is height adjustable relative to the upper surface of the head body.

7. The motorized handheld braiding assembly according to claim 6, wherein:

the two opposing arms of the hair retaining clip are defined by multiple catch slots adapted to form a detachable snap-fit engagement with the at least one latch, whereby the catch slots enable the hair retaining clip to incrementally height adjust.

8. The motorized handheld braiding assembly according to claim 1, wherein:

the hair retaining clip is defined by a U-shape.

9. The motorized handheld braiding assembly according to claim 8, wherein:

the opposing ends of the U-shaped hair retaining clip comprise one or more prong members.

10. The motorized handheld braiding assembly according to claim 1, wherein:

the switch is a momentary switch operably configured to have a translation position completing a circuit between the power source and the electrical motor only when depressed.

11. The motorized handheld braiding assembly according to claim 1, further comprising:

a main power switch operably configured to have a translation position completing a circuit between the power source and the main power switch.

12. The motorized handheld braiding assembly according to claim 1, wherein:

at least one of the two shell members is defined by a flat surface region.

13. The motorized handheld braiding assembly according to claim 12, further comprising:

a protective panel overlaying the flat surface region.

14. The motorized handheld braiding assembly according to claim 1, wherein:

the power source includes at least one of the following: a battery, an electrical outlet, a rechargeable dock, and an A/C-D/C converter.

15. The motorized handheld braiding assembly according to claim 1, wherein:

the head body forms a cylindrical base defined by a cylindrical shape and a top concave portion, and comprising a plurality of flanges.

16. A motorized handheld braiding assembly comprising:

a handheld body having a lower end, an upper end opposing the lower end of the handheld body, and an electrical motor electrically couplable to a power source through a switch having a switch cover, the electrical motor further being operably coupled to a printed circuit board, the electrical motor further being operably coupled to a plurality of discs each operably configured to rotate 360° on a disc axis and each having three equally spaced slots radially disposed on an outer perimeter surface thereon, the discs being rotatable in opposite directions, the handheld body further comprising at least two shell members coupled together about side edges respectively disposed thereon and having upper edges respectively disposed thereon that define an upper perimeter edge, at least one of the two shell members is defined by a flat surface region, the shell members having a grip panel, the handheld body further comprising a body shell cover coupled to the upper perimeter edge, disposed at and defining the upper end of the handheld body, and defining two enclosed and partially connected disc apertures with the plurality discs disposed therein; and multiple hair retention heads each:

disposed at the upper end of the handheld body;

having a head shaft disposed within one of the three equally spaced slots defined by the plurality discs;

having a head body coupled to the head shaft and having a head upper surface, the head body further having a lower wall opposing the upper surface of the head body and defining a lower wall aperture with the head shaft disposed therein, the head body further having an internal head platform translatably disposed within the head body and with the two respective opposing free ends directly coupled thereto, the head body further having a spring interposed between the lower wall of the head body and the internal head platform and biasing the internal head platform toward the upper surface; and a hair retaining clip with two opposing arms defining, with the head upper surface, a hair receiving aperture and operably configured to selectively and longitudinally translate to modulate a diameter of the hair receiving aperture and positionally lock with respect to the head body, the two opposing arms of the hair retaining clip further comprising two respective opposing free ends selectively removably coupled from the head body and at least partially disposed in two clip apertures defined by the upper surface of the head body, the electrical motor operably configured to cause rotation of the plurality discs, and the three hair retention heads to revolve in a sequential figure-8 braiding pattern, thereby braiding a user's hair.

17. The motorized handheld braiding assembly according to claim 16, wherein:

the hair retaining clip is height adjustable relative to the upper surface of the head body.

18. The motorized handheld braiding assembly according to claim 17, wherein:

the two opposing arms of the hair retaining clip are defined by multiple catch slots adapted to form a detachable snap-fit engagement with the at least one latch, whereby the catch slots enable the hair retaining clip to incrementally height adjust.

19. A method of braiding hair with a motorized handheld braiding assembly comprising:

providing a handheld braiding assembly comprising a handheld body, two discs electrically powered to rotate in opposite directions about the upper end of the handheld body, and three hair retention heads fitted into slots that form in the discs and each defining two clip apertures;

raising the height of a hair retaining clip in the hair retention heads, the hair retaining clip defined by a U-shape and a pair of free ends that axially engage the upper end of the handheld body and at least partially disposed in the two slip apertures;

inserting a lock of hair into at least one of the hair retaining clips;

lowering the height of the hair retaining clip, so as to clamp down on the lock of hair;

fastening, with a compressed fastener or a latch, the hair retaining clip to the upper end of the handheld body;

actuating a power switch on the handheld body, the power switch being operatively connected to an electric motor;

rotating the discs in opposite direction, such that the slots in the disc periodically align during 360-degree rotation of the discs;

carrying the hair retention heads along the rotatable path on one of the discs;

passing the hair retention heads between discs when the slots in the disc align during rotation;

rotating the hair retention heads about the first disc, and then sliding the hair retention heads to the second disc, whereby the hair retention heads follow a figure-8 braiding pattern;

braiding the hair in accordance to the figure-8 translation by the hair retention heads; and raising the height of the hair retaining clip to remove the braided hair.

* * * * *